US007040819B2

(12) United States Patent
Takeshita et al.

(10) Patent No.: US 7,040,819 B2
(45) Date of Patent: May 9, 2006

(54) STABLE AREA DETECTION DEVICE OF PLATEN GAP AND RECORDING APPARATUS

(75) Inventors: Sanshiro Takeshita, Nagano (JP); Kazuhiko Yamaguchi, Nagano (JP); Hiroyuki Sugimoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/816,196

(22) Filed: Apr. 2, 2004

(65) Prior Publication Data

US 2004/0258443 A1 Dec. 23, 2004

(30) Foreign Application Priority Data

Apr. 3, 2003 (JP) ..... P2003-100638
Oct. 1, 2003 (JP) ..... P2003-343646

(51) Int. Cl.
*B41J 11/20* (2006.01)

(52) U.S. Cl. ..... 400/58; 400/55; 400/56; 347/8

(58) Field of Classification Search ..... 400/56, 400/58–59, 61
See application file for complete search history.

(56) References Cited

U.S. PATENT DOCUMENTS 5,570,959 A * 11/1996 Moriwaki et al. ..... 400/56
6,171,001 B1 * 1/2001 Nonaka ..... 400/58
2002/0039207 A1 * 4/2002 Kanda ..... 358/498
2002/0067940 A1 * 6/2002 Sasai et al. ..... 400/61

FOREIGN PATENT DOCUMENTS

EP 0 391 829 10/1990
JP 01 228876 9/1989
JP 5-35311 U 5/1993
JP 3027974 B2 2/2000

* cited by examiner

*Primary Examiner*—Andrew H. Hirshfeld
*Assistant Examiner*—Marissa Ferguson
(74) *Attorney, Agent, or Firm*—Sughrue Mion, PLLC

(57) ABSTRACT

In a platen gap adjustment device, a stable area detection device for a platen gap formed between ahead and an upper surface of a platen, wherein the carriage guide shaft is moved relatively to the platen so that the platen gap is adjusted by driving the drive motor to rotate the gap adjuster cam, the gap adjuster cam is configured so as to provide a plurality of stable areas and a plurality transition areas; and wherein a stable area detection sensor is provided so as to face to a rotational member which rotates synchronously with the gap adjuster cam, and a detection object in correspondence with the stable areas of the platen gap is provided on the rotational member.

12 Claims, 15 Drawing Sheets

STABLE AREA DETECTION DEVICE OF PLATEN GAP AND RECORDING APPARATUS

The present application is based on Japanese Patent Applications Nos. 2003-100638 and 2003-343646, the entire contents of which are incorporated herein by reference.

BACKGROUND OF THE INVENTION

1. Field of the Invention

The present invention relates to a recording apparatus. Further, the invention relates to a liquid ejecting device such as an ink jet recording apparatus for ejecting liquid such as ink from its head into an ejection medium.

The liquid ejecting device is not restricted to a recording apparatus including a printer, a copy, and a facsimile which uses an inkjet recording head in order to discharge the ink therefrom into the recording medium, for performing a recording, but it includes a liquid ejection apparatus for ejecting the liquid corresponding to the same purpose, instead of ink, into the ejection medium corresponding to the recording medium, from a liquid ejection head corresponding to the recording head and attaching the above liquid to the ejection medium.

The liquid ejection head includes a color material ejection head for use in color filter manufacture such as a liquid crystal display, an electrode material (conductive paste) ejection head for use in electrode formation such as an organic EL display and a field emission display (FED), a living organic matter ejection head for use in bio chip manufacture, and a sample ejection head as an accurate pipette, other than the recording head.

2. Related Art

In the recording apparatus having a recording head, it is necessary to change a space between the recording head and the upper surface of the platen, that is, a platen gap, depending on the thickness of a recording medium. As the conventional technique for changing the platen gap, there is a technique, as disclosed in Japanese utility model publication No. JP-U-H05-35311, in which the thickness of paper set at the printing section is detected, the gap amount of a printing head is corrected by using a correction value predetermined depending on the detected thickness of the paper, and a print head gap suitable for the paper to be printed is set.

Further, in Japanese Patent publication No 3027974B2, there is an apparatus comprising: a stepping motor for moving a carriage on which a recording head is mounted in a vertical direction of a platen; a rotary encoder with a detection mark provided on its circumference for supplying pulse signals in proportion to the quantity of rotation of the motor, that is, the moving quantity of the carriage; time lag integrating means for moving the carriage from a reference position into the direction of the platen to calculate the integrated value of the time lag between the pulse signal from the rotary encoder and the drive pulse of the stepping motor; and contact judging means for detecting that the integrated value reaches a predetermined value, in which paper thickness calculating means calculates the thickness of the paper according to the number of pulses of the rotary encoder up to the time when the signal is supplied from the contact judging means.

SUMMARY OF THE INVENTION

Although a platen gap has to be switched in several stages depending on the thickness of the recording medium to be used, in the case of switching it by using a cam, there occurs a transition area from the stable area to the next stable area, other than an area where the platen gap becomes stable.

When the turning phase angle of the cam a little deviates because of tolerance, the platen gap is determined at the transition area and accordingly there is a possibility of failing to get the accurate platen gap. An object of the invention is to provide a stable area detection device of a platen gap and a recording apparatus in which a cam can rotate at such an accurate phase angle to get the platen gap in the stable area.

In order to achieve the above object, the invention provides a stable area detection device for a platen gap formed between a head and an upper surface of a platen, in a platen gap adjustment device, the platen gap adjustment device including a carriage guide shaft, a guide shaft gear fixed to an end of the carriage guide shaft, a gap adjuster cam rotatable integrally with the guide shaft gear and formed in a shape to change the platen gap in a plurality of platen gap stages, a cam follower for the gap adjuster cam, and a drive motor for driving the guide shaft gear to rotate, wherein the carriage guide shaft is moved relatively to the platen so that the platen gap is adjusted by driving the drive motor to rotate the gap adjuster cam, the gap adjuster cam is configured so as to provide a plurality of stable areas corresponding to the platen gap stages where the platen gap is constant while a rotational phase of the gap adjuster cam varies in a predetermined range and a plurality transition areas where the platen gap changes between the stable areas as the rotational phase of the gap adjuster cam varies;

wherein a stable area detection sensor is provided so as to face to a rotational member which rotates synchronously with the gap adjuster cam, and a detection object in correspondence with the stable areas of the platen gap is provided on the rotational member.

According to the first aspect of the invention, since the gap adjuster cam is prevented from standing in the transition area where there is a change in the platen gap, it is possible to perform the recording on the recording medium at high quality.

The stable area detection device of platen gap according to the second aspect of the invention is constituted in that in addition to the first aspect, the stable area detection sensor includes a light emitting portion and a light receiving portion and the detection object comprises a light shielding plate which passes between the light emitting portion and the light receiving portion. According to this aspect, since the light shielding plate prevents the light receiving portion from receiving the light emitted from the light emitting portion, the light shielding state or the light passing state can be detected as the stable area.

The stable area detection device of platen gap according to the third aspect of the invention is constituted in that, in addition to the first aspect or the second aspect, the detection object detected by the detection sensor for the stable areas is formed in correspondence with a central portion in each stable area, other than adjacent portions to the transition areas formed in both ends of said stable area. According to this aspect, it is possible to prevent the stable area detection sensor from misidentifying the transition area to be the stable area.

The stable area detection device of platen gap according to the fourth aspect of the invention is constituted in that, in addition to one of the first aspect to the third aspect, a home position detection sensor is provided so as to face to the rotational member, and the rotational member is provided with anther detection object for the home position detection sensor at a position where the gap adjuster cam is located in a home position. According to this aspect, since the home position of the gap adjuster cam can be detected easily, it can contribute to the improvement of throughput.

The stable area detection device of platen gap according to the fifth aspect of the invention is constituted in that, in addition to the fourth aspect, the position where the gap adjuster cam is located in the home position is a boundary portion between the stable area of a maximum platen gap stage and the transition area adjacent to the stable area of the maximum platen gap stage. According to this aspect, even when a user turns on the printer without knowing there is foreign substance under the recording head, since the platen gap is enough, it is possible to decrease a possibility of damaging the recording head owing to the foreign substance, through the scanning operation of the recording head.

The stable area detection device of platen gap according to the sixth aspect of the invention is constituted in that, in addition to one of the first aspect to the third aspect, the gap adjuster cam includes a restricting mechanism for restricting a rotation thereof so as to be rotatable in a range from the stable area of a minimum platen gap stage to the stable area of the maximum platen gap stage.

In this aspect, according to the restricting mechanism for restricting the rotation range of the gap adjuster cam so as to be rotatable in a range from the stable area of the minimum platen gap to the stable area of the maximum platen gap, when the stable area sensor detects no change for a predetermined hour even when a driving force is given to the gap adjuster cam, it is possible to recognize that it means the minimum platen gap or the maximum platen gap, figuring out the current position without providing another sensor for the exclusive use.

The recording apparatus of the invention for performing a recording on a recording medium comprises the stable area detection device of platen gap, according to one of the first aspect to the sixth aspect. According to this aspect, since the platen gap can be always kept at a stable distance, it is possible to perform the recording on the recording medium at high quality.

The liquid ejection apparatus of the invention for ejecting a liquid on a liquid ejection medium comprises the stable area detection device of platen gap, according to one of the first aspect to the sixth aspect.

DETAILED DESCRIPTION OF THE PREFERRED EMBODIMENTS

<First Embodiment>

Figure 1:
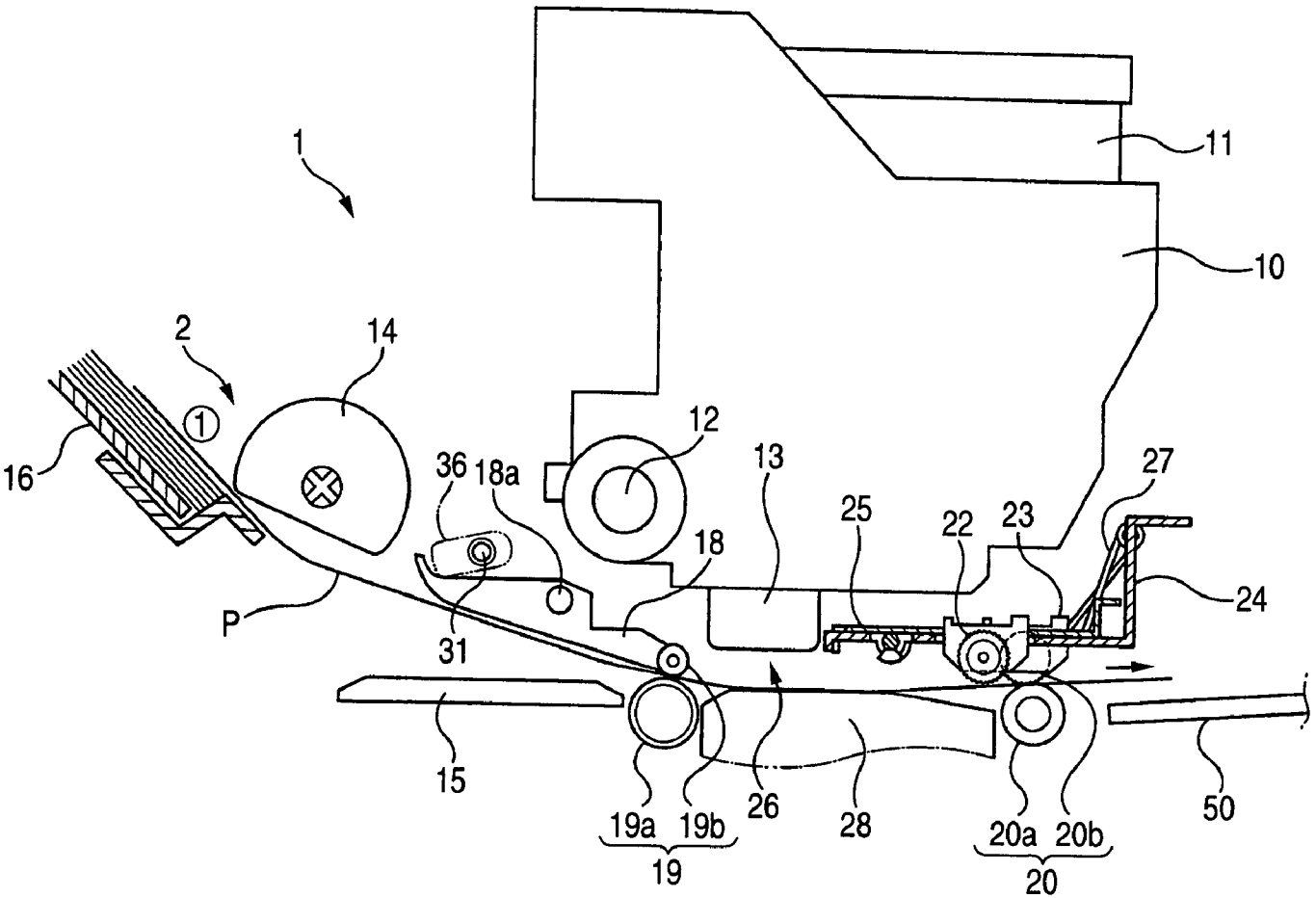
FIG. 1 is a cross sectional side view of the recording apparatus having the stable area detection device of the platen gap according to the invention.
Figure 2:
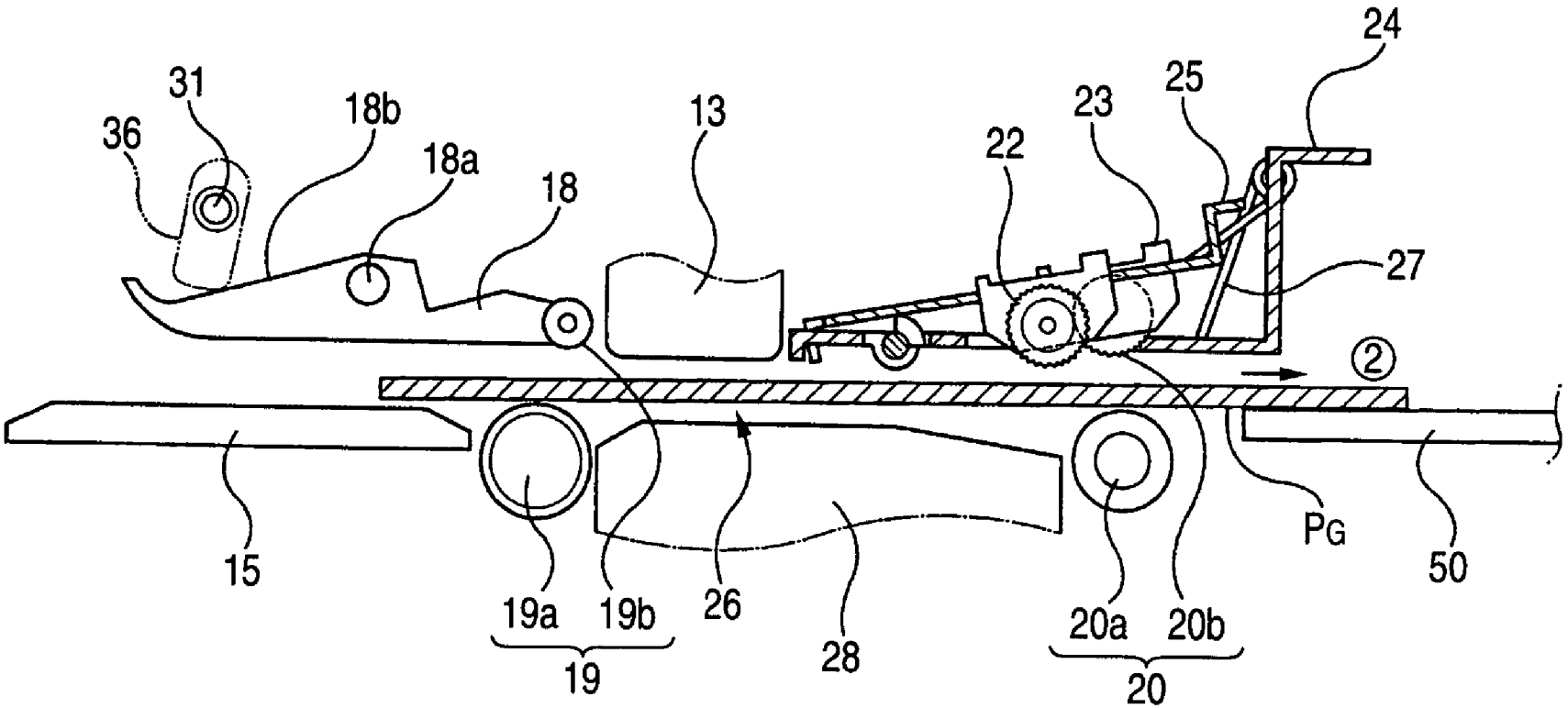
FIG. 2 is a cross sectional side view showing the state of feeding the stiff recording medium.
Figure 3:
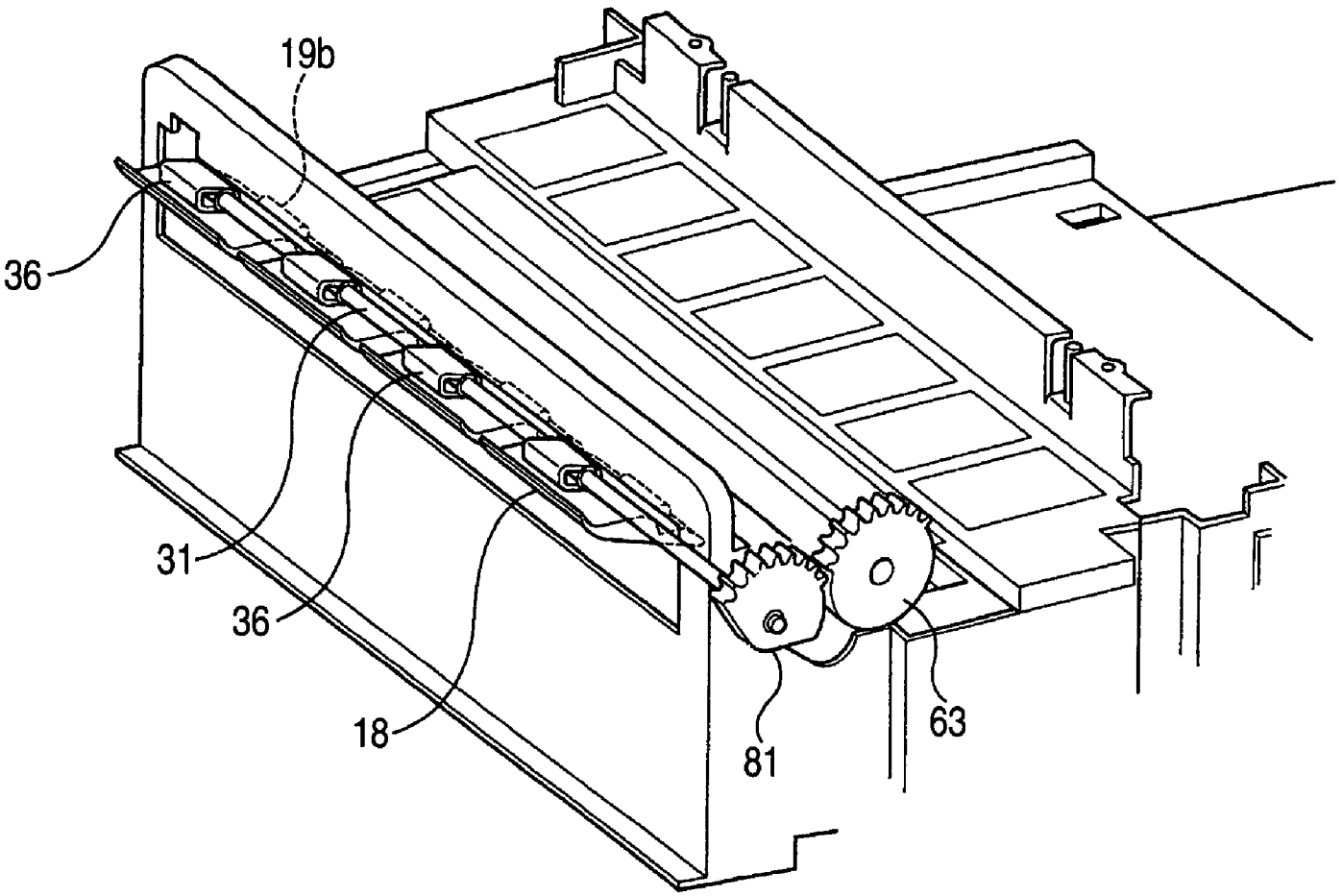
FIG. 3 is a perspective view of the transport-driven roller holder and its vicinity when feeding the flexible recording medium.

Hereinafter, a first embodiment of the present invention will be described with reference to the drawings. FIG. 1 is a cross sectional side view showing an ink jet printer (hereinafter, referred to as a printer) as one example of a recording apparatus including a stable area detection device of platen gap, according to the invention, FIG. 2 is a cross sectional side view showing the state of feeding a stiff recording medium, FIG. 3 is a perspective view of a transport-driven roller holder and its vicinity when feeding a flexible recording medium. Although the invention can be applied to an ejection medium on which surface, instead of ink, liquids corresponding to other applications are ejected, other than the recording medium such as paper and the like, the recording medium will be hereafter described representatively.

A printer 1 comprises a feeding section 2 for feeding a recording medium P, at the upstream side and the feeding section 2 keeps a stack of the recording mediums P in a slanting state and transports the recording mediums P one by one to the downstream. When the recording medium is flexible like paper, the recording medium is transported to the recording process through a feeding path as illustrated in the circled number 1 in FIG. 1, when the recording medium has rigidity (stiff recording medium), it is transported to the recording process through the feeding path as illustrated in the circled number 2 in FIG. 2.

The feeding section 2 comprises a hopper 16 and the hopper 16 holds a stack of the recording mediums in a slanting state. The hopper 16 is provided with a rotational support point at the upstream side and by turning around the rotational support point, it is formed so as to release or contact with a feeding roller 14 formed in a substantially D-shape from a side view. The recording medium P is pushed up by the clamping operation toward the feeding roller 14 and the uppermost one of the recording mediums P is made into contact with the feeding roller 14. In this state, the feeding roller 14 is rotated so as to transport the recording medium P to the downstream.

A plate-shaped guide 15 is provided almost horizontally in the downstream of the feeding roller 14, and the distal end of the recording medium P transported from the feeding section 2 is in contact with the guide 5 and smoothly and flexibly directed to the downstream. A transporting roller 19 including a transport-driving roller 19*a* of rotationally moving by a driving unit not illustrated and a transport-driven roller 19*b* of rotating together in contact with the transport-driving roller 19*a* is provided in the downstream from the guide 15, and the recording medium P is pressed by the transporting roller 19 and given a driving force to the downstream. The transport-driving roller 19*a* is formed in a cylindrical roller long in a main scanning direction and a plurality of the transport-driven rollers 19*b* are provided shortly in the main scanning direction at predetermined intervals in the main scanning direction.

The transport-driven roller 19*b* is supported by a shaft on the downstream side of the transport-driven roller holder 18. The transport-driven roller holder 18 is provided in a rotative way around the rotation axis 18*a*, and the transport-driven roller 19*b* is always urged rotationally into close contact with the transport-driving roller 19*a* by a helical torsion spring (not illustrated).

The transport-driven roller 19*b* can be turned into a retreat state of retreating upwardly by the rotation of the transport-driven roller holder 18 around the rotational support point 18*a*, as illustrated in FIG. 2.

Namely, a cam 36 is provided in a driven roller release shaft 31 in a way of coming into contact with a cam follower 18*b* on the upstream portion of the transport-driven roller holder 18, the cam 36 is coming into contact with the cam follower 18*b* from top down, according to the rotation of the release shaft 31, and the transport-driven roller holder 18 is rotated around the rotational support point 18*a*. Thus, the transport-driven roller 19*b* retreats upwardly, to thereby be in a retreat state as shown in FIG. 2. When the cam 36's contact with the cam follower 18*b* is released, the transport-driven roller 19*b* is rotationally urged toward the transport-driving roller 19*a* by the helical torsion spring (not illustrated) and returned into a contact state as shown in FIG. 1. Here, a reference mark $P_G$ is attached particularly to the stiff recording medium which is difficult for the transporting roller to nip, for distinction.

Further, a recording section 26 for performing a recording on the recording medium P is provided on the downstream of the transporting roller 19. A platen 28 and a recording head 13 are arranged in the recording section 26 so as to vertically oppose to each other. The platen 28 is formed long in the main scanning direction and supports the recording medium P transported to the recording section 26 upwardly.

The recording head 13 is provided in the bottom of a carriage 10 capable of holding an ink cartridge 11 and the carriage 10 can reciprocate in the main scanning direction while being directed by a carriage guide shaft 12 extending in the main scanning direction. The distance between the upper surface of the platen 28 and the recording head 13, that is, a platen gap (hereinafter, there may be some cases of abbreviating as PG) is an important element for determining the recording accuracy, and it is necessary to properly adjust it depending on the thickness of the recording medium P. The PG adjustment will be described later.

The downstream portion from the recording section 26 forms a discharge portion of the paper P in the printer 1, which is provided with a discharge roller 20 including a discharge-driving roller 20*a* of rotationally moving by the driving means not illustrated and a discharge-driven roller 20*b* of being driven while being lightly clamped with the discharge-driving roller 20*a*. The recording medium P on which the recording by the recording section 26 has been performed is clamped by the discharge roller 20 and discharged onto a stacker 50 according to the rotation (normal rotation) of the discharge-driving roller 20*a*.

The discharge-driven roller 20*b* is a toothed roller having a plurality of teeth around its outer periphery and supported by a discharge-driven roller holder 23 in a rotatable way. The discharge-driven roller holder 23 is formed in a plate shape long in the main scanning direction and it is fixed to a discharge sub frame 25 extending almost horizontally from the vicinity of the recording head 13 toward the downstream along the discharge path of the recording medium P. The discharge sub frame 25 is attached to a discharge main frame 24 long in the main scanning direction and formed in a plate shape extending substantially horizontally from the vicinity of the recording head 13 toward the downstream, by a coil spring 27 in a way of downwardly pressing.

A discharge auxiliary roller 22 is provided in the upstream of the discharge-driven roller 20*b* and the recording medium P is slightly pressed downward by the discharge auxiliary roller 22. The position of the core axis of the transport-driven roller 19*b* is positioned in the downstream further than that of the transport-driving roller 19*a*, and the position of the core axis of the discharge-driven roller 20*b* is positioned in the upstream further than that of the discharge-driving roller 20*a*. According to this structure, the recording medium P is a little curved and convexed downwardly between the transporting roller 19 and the discharge roller 20, and the recording medium P facing the recording head 13 is pushed down on the platen 28, to thereby prevent from floating up of the recording medium P and correctly perform the recording thereon.

Figure 4:
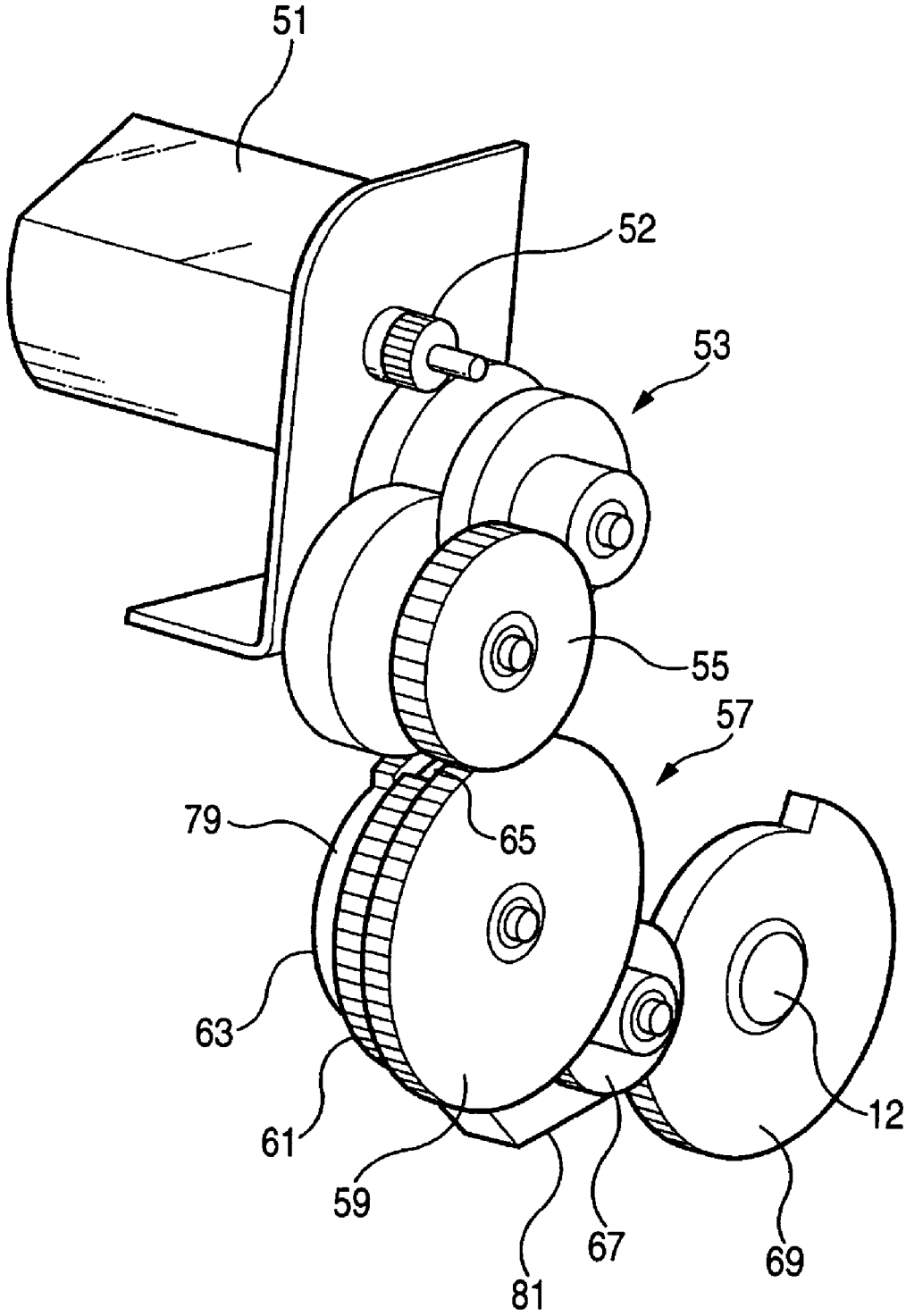
FIG. 4 is a perspective view of a driving force transmission branch gear and its vicinity.
Figure 6:
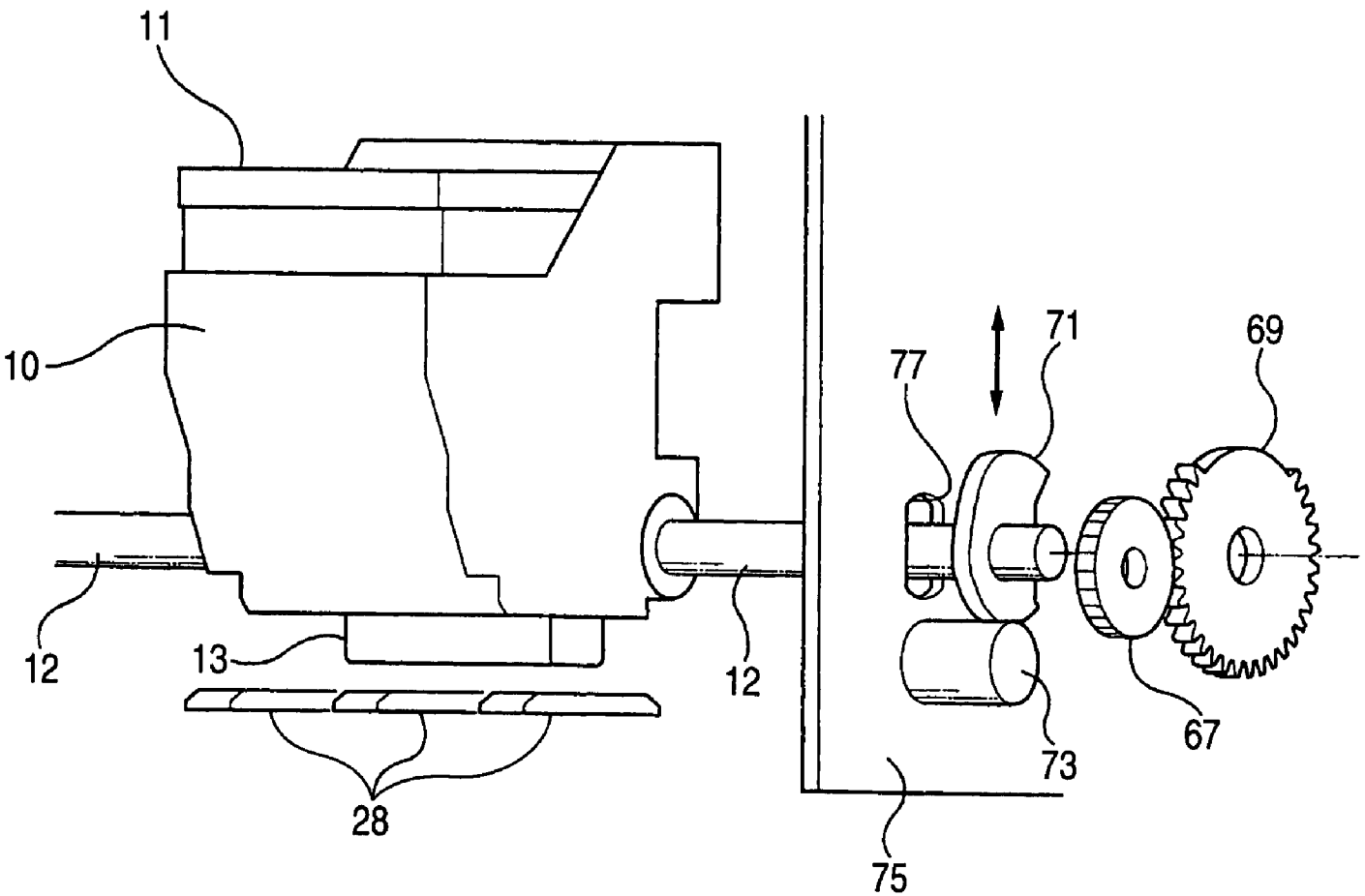
FIG. 6 is a perspective view showing the structure of vertically moving the carriage guide shaft.
Figure 7:
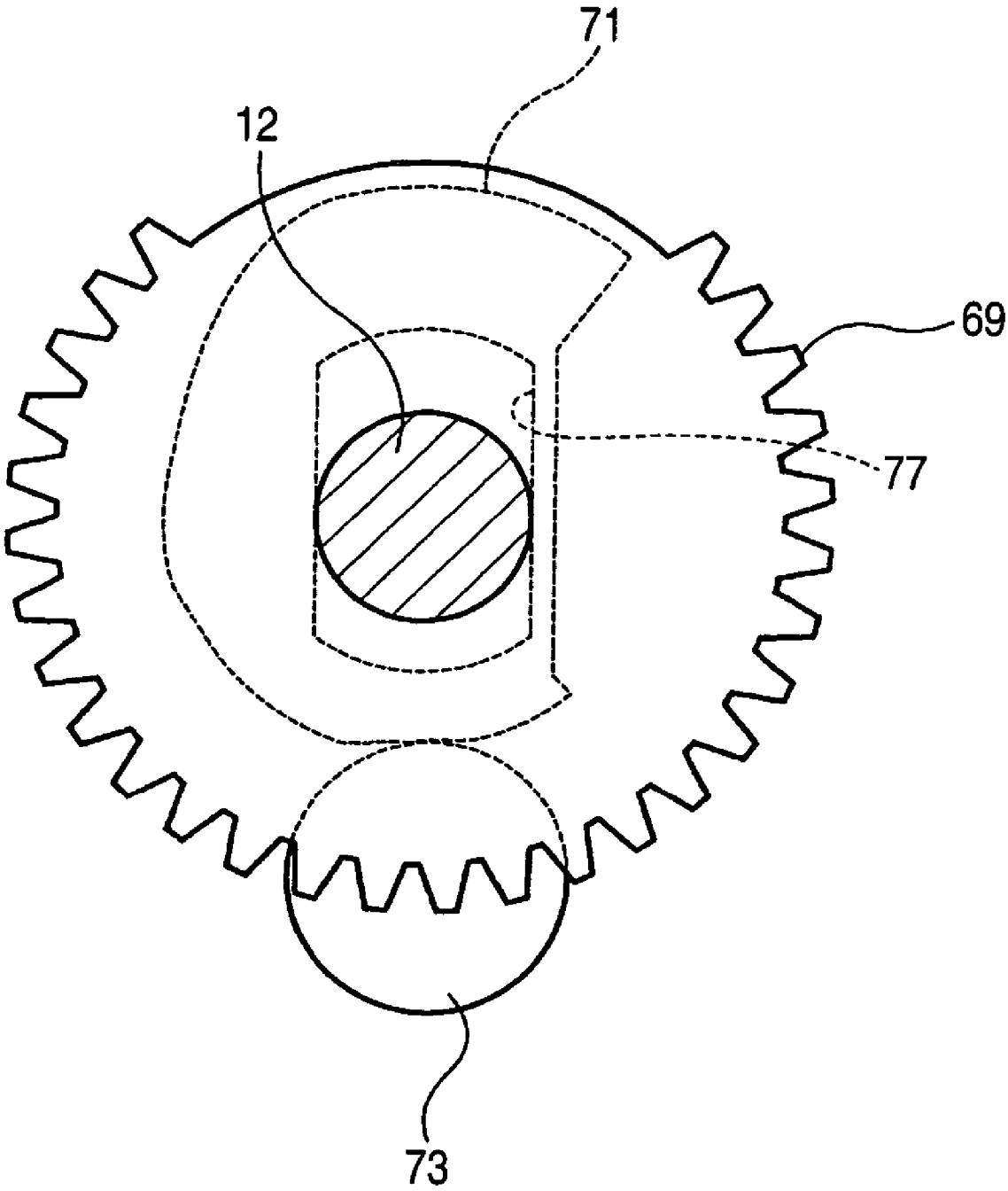
FIG. 7 is a front view showing the structure of a gap adjuster cam and its vicinity.
Figure 8:
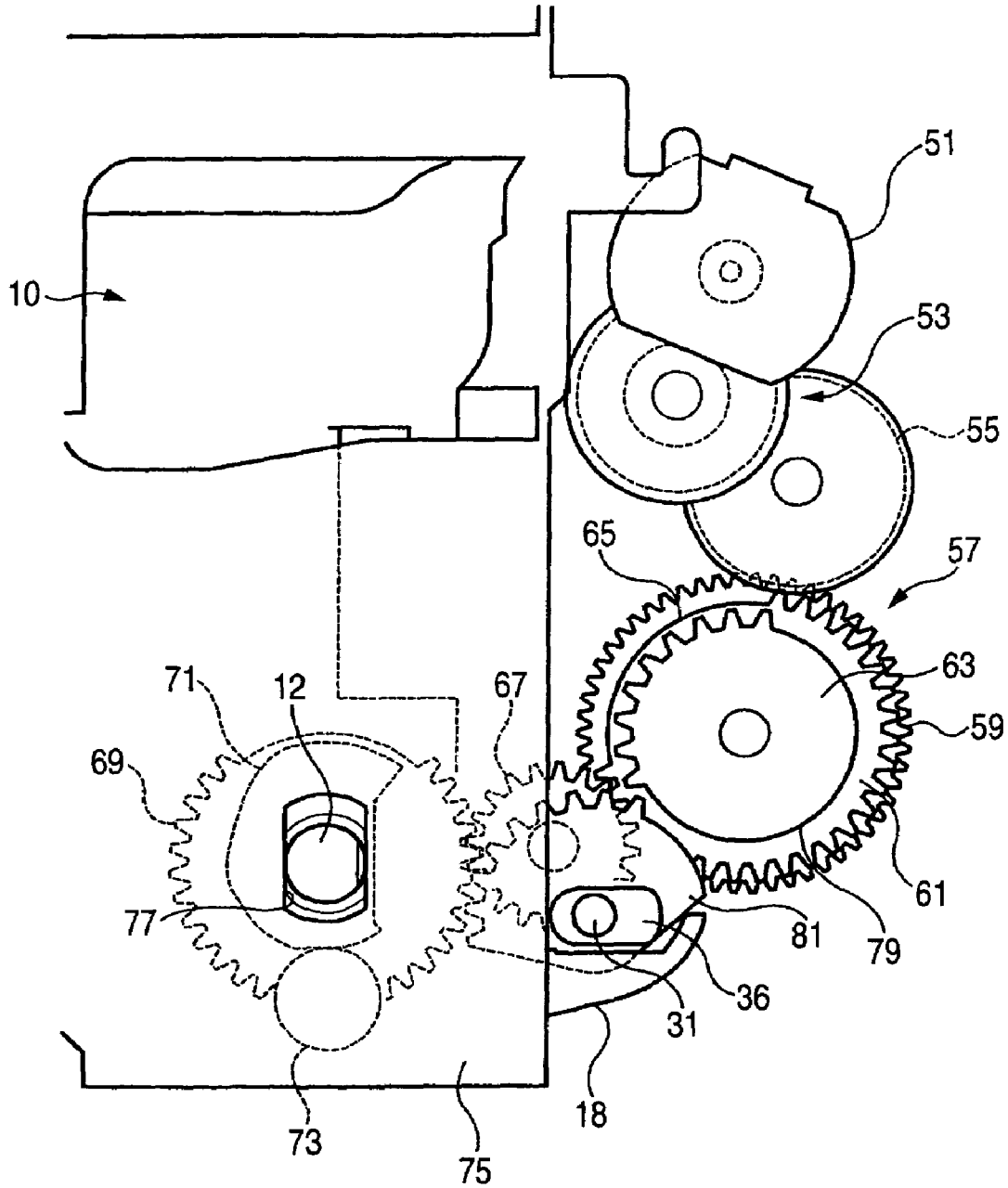
FIG. 8 is a side view of the driving force transmission branch gear and its vicinity.

The driving mechanism of the cam 36 for retreating the PG adjusting mechanism and the transport-driven roller 19*b* upwardly will be described with reference to FIGS. 4 to 8. FIG. 4 is a perspective view of the vicinity of a driving force transmission branch gear, FIG. 5 is a cross sectional side view showing the state of engagement of the driving force transmission branch gear and its vicinity, FIG. 6 is a perspective view showing the structure of vertically moving the carriage guide shaft, FIG. 7 is a front view showing the structure of a gap adjuster cam and its vicinity, and FIG. 8 is a lateral side view of the driving force transmission branch gear and its vicinity.

Figure 5:
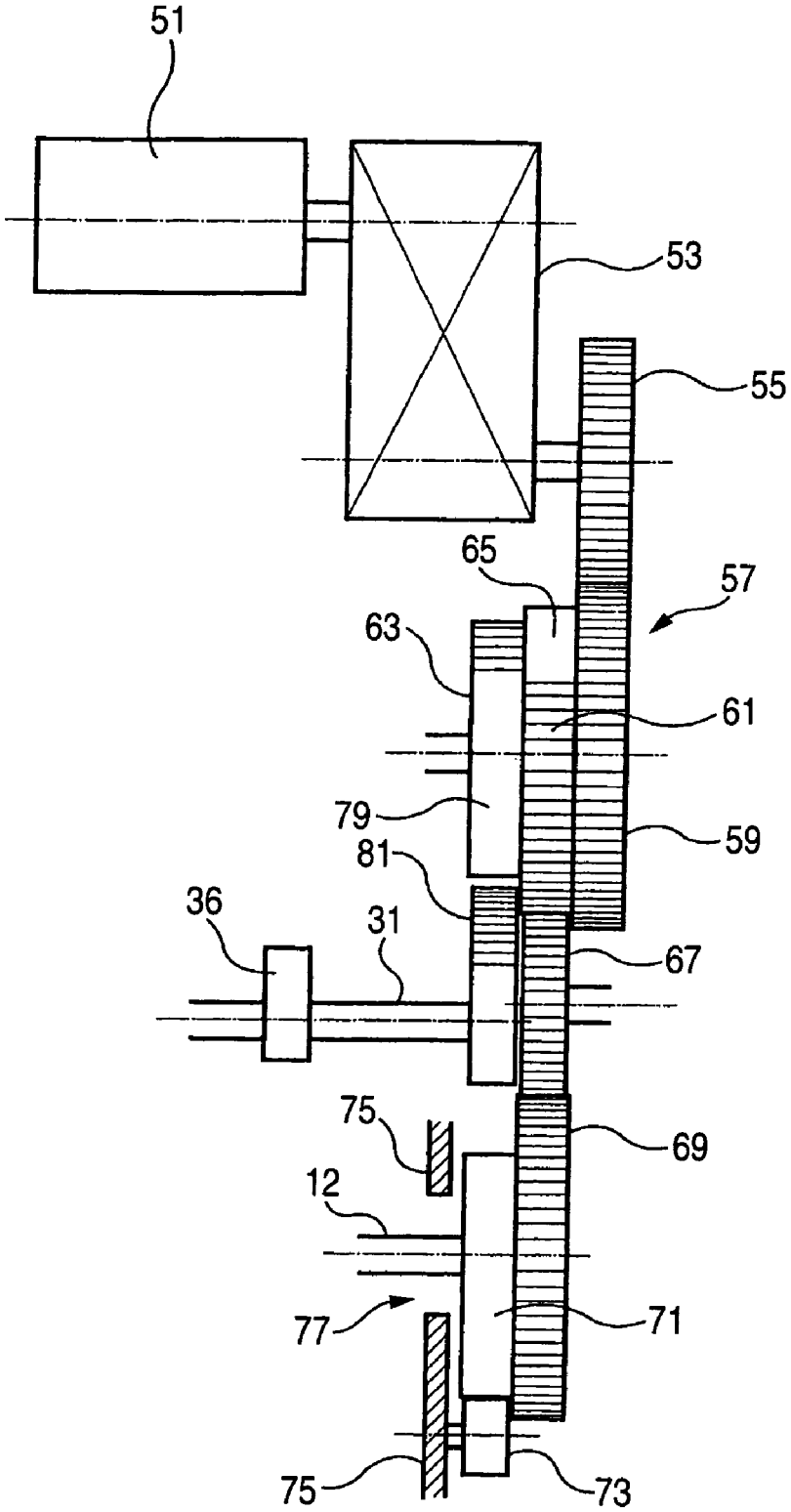
FIG. 5 is a cross sectional side view showing the state of engagement of the driving force transmission branch gear and its vicinity.

As shown in FIG. 4 and FIG. 5, the printer 1 is provided with a drive motor 51 for driving the PG adjustment device and cam 36. A driving pulley 52 of the drive motor 51 transmits a driving force to an input gear 55 through an input gear mechanism 53 consisting of a gear train and the input gear 55 is engaged in a driving force transmission branch gear 57.

As well illustrated in FIG. 5, the driving force transmission branch gear 57 is formed in three gear stages including a main gear 59 to be engaged in the input gear 55, a first output gear 61 and a second output gear 63 fixed to the main gear 59, for integrally rotating together. A toothless portion 65 is formed on one of the outer peripheral portion of the first output gear 61 and the other teeth of the gear can be engaged in an intermediate gear 67 adjacent to the first output gear 61. The function of the toothless portion 65 in the first output gear 61 will be described later.

The intermediate gear 67 is engaged in a guide shaft gear 69 and a carriage guide shaft 12 is fixed at the center of the guide shaft gear 69. A gap adjuster cam 71 which rotates synchronously with the guide shaft gear 69 is fixed to the carriage guide shaft 12 adjacent to the guide shaft gear 69 and a fixed pin 73 working as a cam follower is fixed in the vicinity of the gap adjuster cam 71.

As illustrated in FIG. 6, FIG. 7, and FIG. 8, the carriage guide shaft 12 penetrates into a guide groove 77 extending longitudinally, which is formed on the frame 75 of the printer 1, and accordingly, only the vertical movement is permitted and the horizontal movement is not permitted. According to this structure, when a rotational driving force is given to the guide shaft gear 69 from the drive motor 51, the gap adjuster cam 71 begins to rotate and according to the function of the outer peripheral surface of the gap adjuster cam 71 and the fixed pin 73, the carriage guide shaft 12 moves vertically. As a result, the carriage 10 supported by the carriage guide shaft 12 also moves vertically, to thereby adjust the platen gap (PG).

On the other hand, a toothless portion 79 is also formed in one of the outer peripheral portion of the second output gear 63 and the other teeth of the gear can be engaged in a cam driving gear 81 fixed to the end portion of the driven roller release shaft 31. The function of the toothless portion 79 in the second output gear 63 will be described later.

According to this structure, when a rotational driving force is given to the driven roller release shaft 31 from the drive motor 51, the driven roller release shaft 31 and the cam 36 also begin to rotate, and the function of the cam 36 and the cam follower 18*b* as mentioned above can realize the state of retreating the transport-driven roller 19*b* upwardly and the state of keeping it into contact with the transport-driving roller 19*a*.

As mentioned above, use of the driving mechanism for the platen gap adjustment enables the retreat state and the contact state of the transport-driven roller 19*b*, and therefore, it is not necessary to prepare for another driving mechanism separately, which makes the structure simple and decreases the cost.

Figure 9:
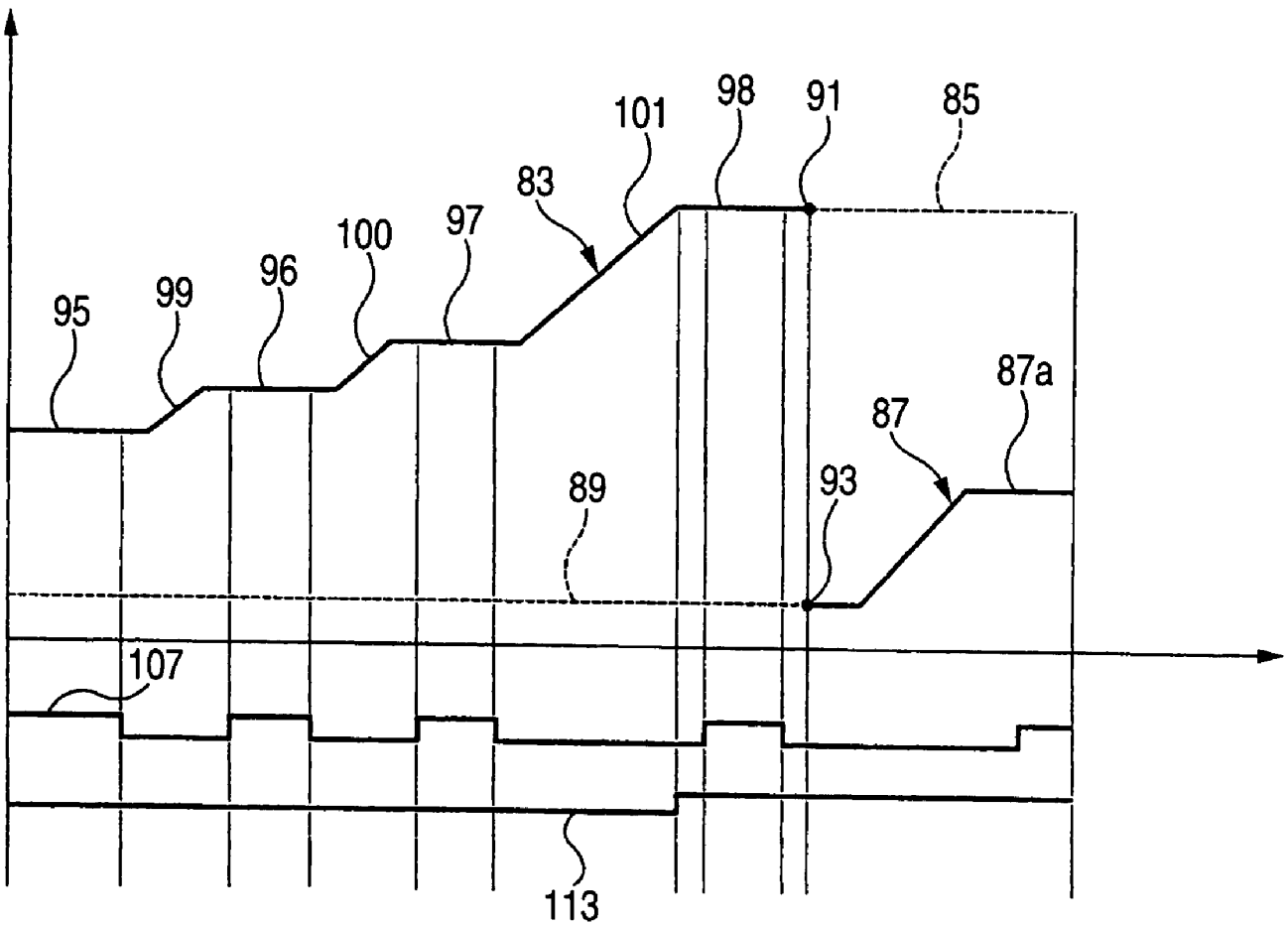
FIG. 9 is a graph showing the PG displacement, the retreating operation of the transport-driven roller, and the sensor detection state.
Figure 10:
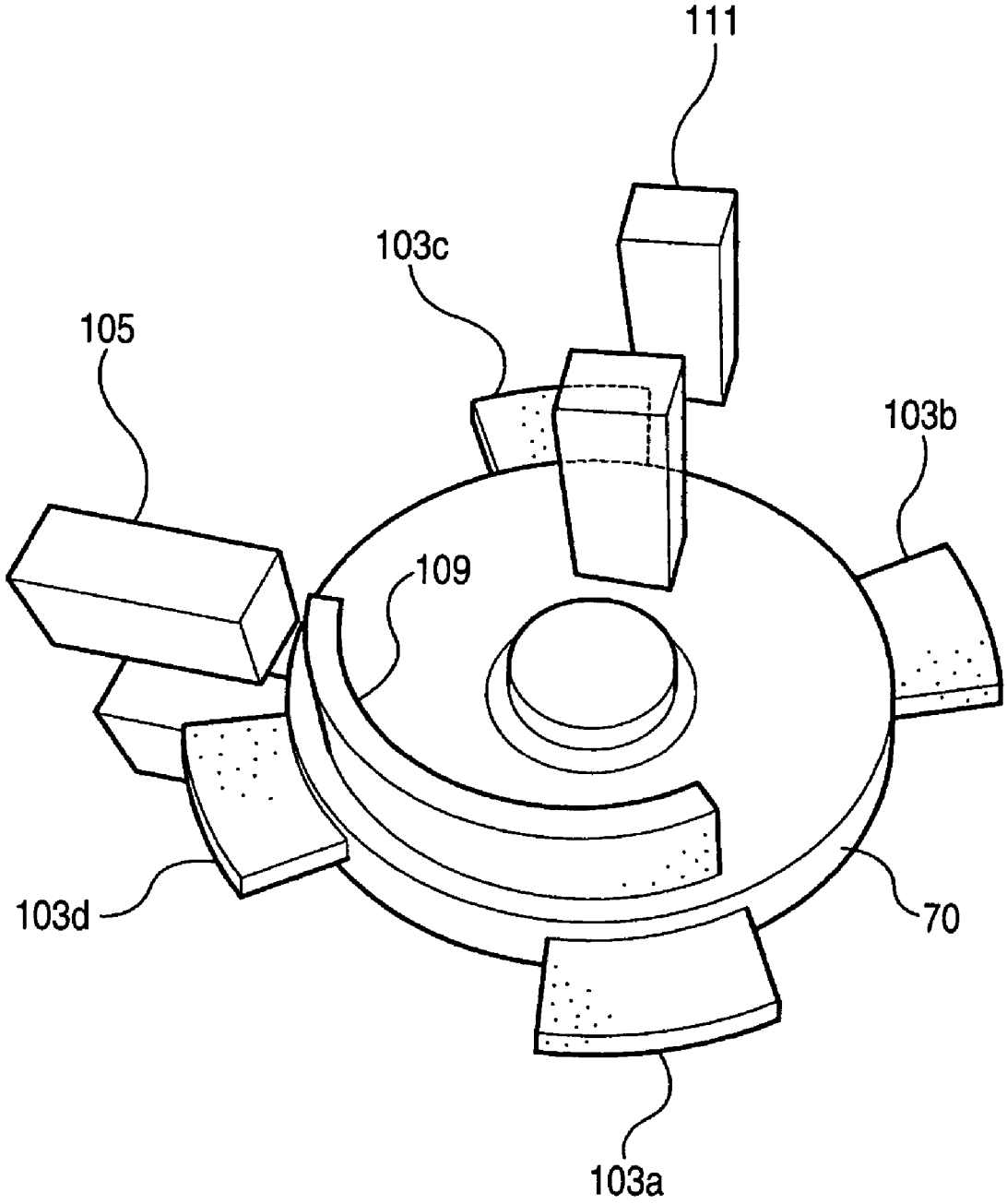
FIG. 10 is a top view showing a sensor provided in a disc coaxial with the guide shaft gear.

Hereinafter, with reference to FIG. 9 and FIG. 10, adjustment of a platen gap, and the retreat state and the contact state of the transport-driven roller 19*b* realized by the above structure will be described. FIG. 9 is a graph showing a displacement of the platen gap, the retreating operation of the transport-driven roller 19*b*, and the detection state of a sensor, according to the rotation of the drive motor 51, and FIG. 10 is a perspective view showing the sensor provided on a disc 70 (rotational member) coaxial with the guide shaft gear 69.

In FIG. 9, the horizontal axis indicates the rotational phase position of the drive motor 51, the right is the direction of counterclockwise rotation from a viewpoint of the output shaft and the left is the direction of clockwise rotation. A solid line 83 in FIG. 9 indicates a displacement of the platen gap accompanying the rotation of the drive motor 51 and it shows that the displacement becomes larger according to the upper direction of the vertical axis. A broken line 85 continued to the solid line 83 at the right side shows the state in which the toothless portion 65 of the first output gear 61 faces the intermediate gear 67 and therefore the rotational driving force of the drive motor 51 is not transmitted to the gap adjuster cam 71.

The solid line 87 indicates the displacement of the driven-roller release shaft 31 at a time of performing the retreating and contact operation of the transport-driven roller 19*b*, and in this case, the upper direction of the vertical axis indicates how much the transport-driven roller 19*b* is removed upward from the contact state, and the horizontal portion 87*a* at the right end of the solid line 87 indicates the retreat completion state of the transport-driven roller 19*b*. The broken line 89 continued to the solid line 87 at the left side indicates the state in which the toothless portion 79 of the second output gear 63 faces the cam driving gear 81 and therefore the rotational driving force of the drive motor 51 is not transmitted to the driven roller release shaft 31. The horizontal line indicated by the broken line 89 indicates the contact state of the transport-driving roller 19*a* and the transport-driven roller 19*b*.

In FIG. 9, as apparent from the positional relationship between the boundary point 91 of the solid line 83 and the broken line 85 and the boundary point 93 of the solid line 87 and the broken line 89, the toothless portion 65 of the first output gear 61 is formed in the range of the second output gear 63 and the cam driving gear 81 being in mesh, and contrary, the toothless portion 79 of the second output gear 63 is formed in the range of the first output gear 61 and the intermediate gear 67 being in mesh.

If the driving force of the drive motor 51 is transmitted also to the driven-roller release shaft 31, when this driving force should be transmitted to the gap adjuster cam 71 through the first output gear 61, the transport-driven roller 19*b* could retreat when it should not and the transport-driven roller 19*b* could come into contact with the transport-driving roller 19*a* when it should retreat. The reason for forming the toothless portion 79 in the second output gear 63 is to avoid such the draw back.

On the other hand, the reason for forming the toothless portion 65 in the first output gear 61 is to decrease the load on the drive motor 51 by releasing the engagement of the first output gear 61 and the intermediate gear 67 by the toothless portion 65 because the load on the drive motor 51 is increased when the rotational driving force is transmitted to the driven roller release shaft 31. When it is not necessary to decrease the load on the drive motor 51, it is not necessary to form the toothless portion 65 in the first output fear 61.

As shown by the solid line 83 in FIG. 9, this example can select a platen gap in four stages. The horizontal portion of the solid line 83 indicates stable areas 95, 96, 97, and 98 of PG (–, Typ, +, ++) in the four stages. The stable area 96 indicated by "Typ" corresponds to the PG for the paper having usual thickness, the stable area 95 indicated by "–" corresponds to the PG for thin paper, the stable area 97 indicated by "+" corresponds to the PG for the paper slightly thicker than the usual paper, and the stable area 98 indicated by "++" corresponds to the PG for the further thicker paper. Transition areas 99, 100, and 101 for transiting to the respective stable areas are formed respectively between the stable areas 95 and 96, 96 and 97, 97 and 98.

In order to keep the platen gap constant during recording into the recording medium, it is necessary to fix the platen gap at one of the stable areas 95, 96, 97, and 98 not at any of the transition areas 99, 100, and 101. As shown in FIG. 10, four light-shielding plates 103*a*, 103*b*, 103*c*, and 103*d* are formed in a protruding way at intervals on the outer periphery of a disc 70 coaxial with the guide shaft gear 69, and an optical stable area detection sensor 105 is provided at a position adjacent to the outer periphery of the guide shaft gear 69. The stable area detection sensor 105 has a light emitting portion and a light receiving portion, and it is to detect the presence of the light shielding plate depending on whether or not the light emitted from the light emitting portion is received by the light receiving portion.

The respective positions of the four light shielding plates 103*a*, 103*b*, 103*c*, and 103*d* on the outer periphery of the disc 70 correspond to the respective stable areas 95, 96, 97, and 98, and when one of the four light shielding plates shields the light of the stable area detection sensor 105, a judging unit, not illustrated, judges that the platen gap is in the stable area. The judging unit makes a judgment which light shielding plate is now shielding the light and which stable area the GP is standing in, through sequentially shielding the light of the stable area detection sensor 105 by the four light shielding plates 103*a*, 103*b*, 103*c*, and 103*d*.

In FIG. 9, the solid line 107 indicates the position where the light of the stable area detection sensor 105 is shielded, correspondingly to the solid line 83 indicating each stage of the platen gap. As for the solid line 107, the stepped-up portion indicates "light shield state" and the stepped-down portion indicates "light pass state". As is apparent from the comparison between the solid line 107 and the solid line 83, the four light shielding plates 103*a*, 103*b*, 103*c*, and 103*d* do not completely conform to each length of the stables areas 95, 96, 97, and 98, but each circumferential length of the light shielding plates is determined in a way of corresponding to each central area of the stable areas 95, 96, 97, and 98 excluding each transition area and each neighboring end portion. This can prevent the stable area detection sensor 105 from misidentifying the transition area to be the stable area, taking the tolerance into consideration.

As illustrated in FIG. 10, an arc-shaped light shielding plate 109 is formed in predetermined length on one surface of the disc 70, and a home position detection sensor 111 including a light emitting portion and a light receiving portion is provided on the same surface of the disc 70. The home position detection sensor 111 is provided in order to determine the home position of the gap adjuster cam 71 and the solid line 113 of FIG. 9 indicates the light shield and the light pass by the home position detection sensor 111, correspondingly to the solid line 83 indicating the stages of the platen gap.

As for the solid line 113, the stepped-up portion on the right indicates the "light shield state" and the stepped-down portion on the left indicates the "light pass state". As is apparent from the comparison between the solid line 113 and the solid line 83, it is found that the home position detection sensor 111 turns from the "light pass state" to the "light shield state" at the point when the transition area 101 moves to the stable area 98 as for the solid line 83. Namely, in this example, the point of moving from the transition area 101 to the stable area 98 where the platen gap becomes the maximum is defined as a home position and the home position can be found by detecting the change from the "light pass state" to the "light shield state" in the home position detection sensor 111 or the inverse change. Further, by defining the point of moving from the transition area 101 to the stable area 98 where the platen gap becomes maximum, as the home position, even when a user turns on the power of the printer 1 without knowing there is foreign substance under the recording head 13, since the platen gap is enough, it is possible to decrease the possibility of damaging the recording head 13 by the foreign substance through the scanning operation of the recording head 13.

<Second Embodiment>

Figure 11A:
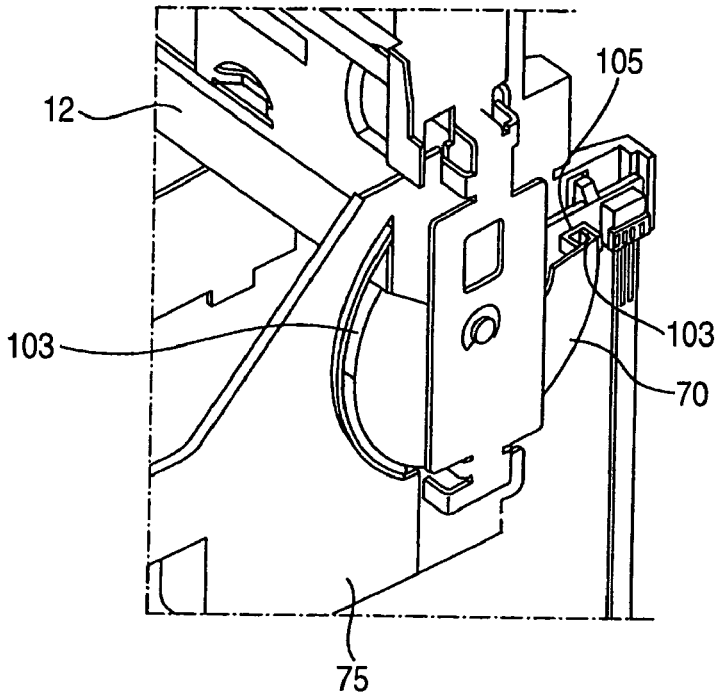
FIGS. 11A and 11B are perspective views showing the sensor provided in a disc coaxial with the guide shaft gear according to the second embodiment.
Figure 11B:
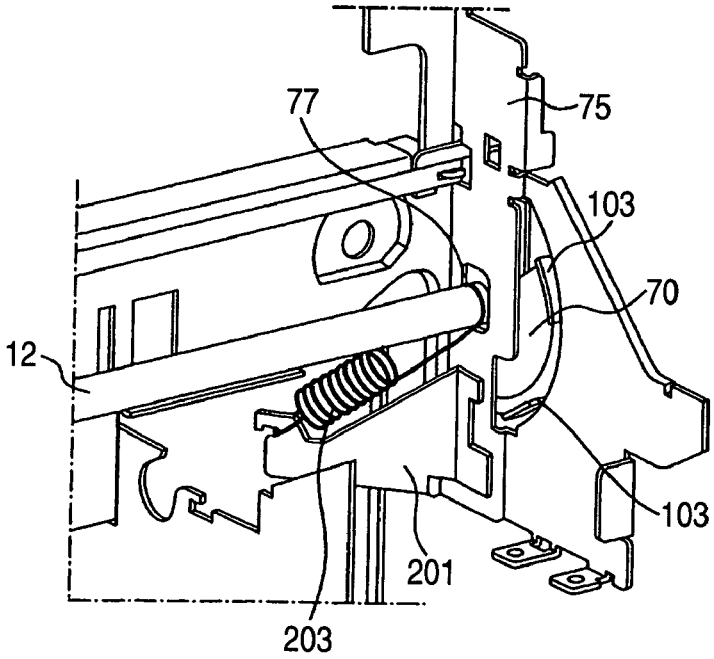
Figure 12A:
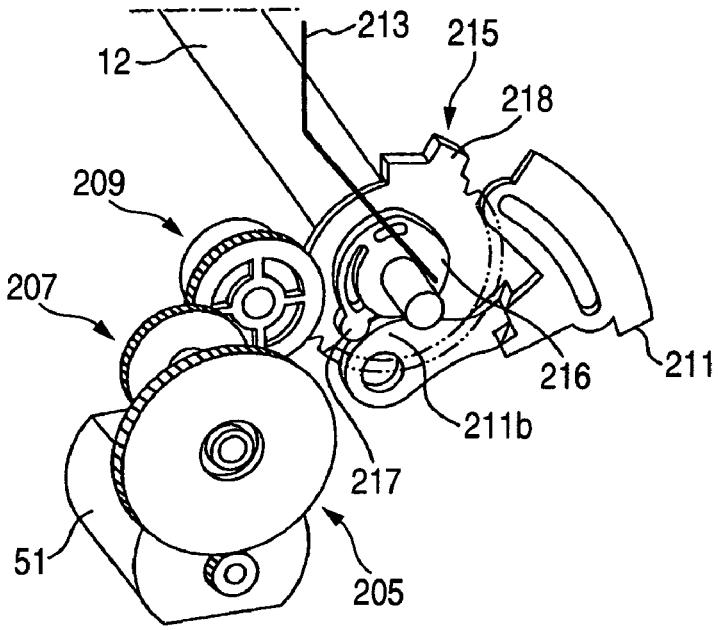
FIGS. 12A and 12B are a perspective view and a side view showing the structure of vertically moving the carriage guide shaft.
Figure 12B:
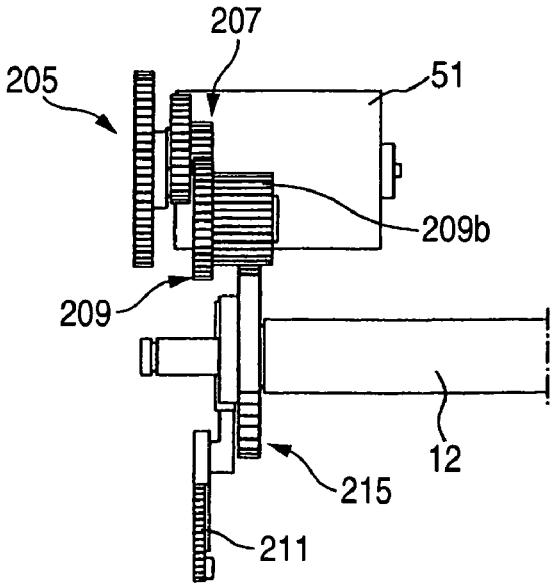

Hereinafter, a second embodiment of the invention will be described with reference to FIGS. 11A to 14. The second embodiment described later is made by changing the structure of the PG adjusting mechanism of the above mentioned first embodiment. Here, FIGS. 11A and 11B are perspective views showing a sensor provided on a disc coaxial with the guide shaft gear, FIGS. 12A and 12B are perspective view and side view showing the structure of vertically moving the carriage guide shaft, FIGS. 13A to 13D are front views each showing the structure of vertically moving the carriage guide shaft, and FIG. 14 is a graph showing the PG displacement and the sensor detection state. In the second embodiment, the same reference numeral is attached to the same component as that in the above-mentioned first embodiment, and the description thereof is omitted.

Although the PG adjusting mechanism according to this embodiment is provided on the left end portion of the carriage guide shaft 12, the structure of the right end portion will be described at first. In FIGS. 11A and 11B, a guide groove 77 extending along the vertical direction, for supporting the carriage guide shaft 12 is formed on the right surface of the frame 75 formed in a substantially U-shape from lateral side view (the guide groove 77 is also formed on the left surface thereof), and the both ends of the carriage guide shaft 12 are inserted into the guide grooves 77. The disc 70 is mounted on each shaft end portion of the carriage guide shaft 12, and four light shielding plates 103 are formed on the outer periphery of the disc at predetermined intervals. Though these light shielding plates are formed in a way of standing at right angles to the disc, differently from the light shielding plates 103*a* to 103*d* according to the first embodiment shown in FIG. 10, the other structure and function and effect are the same and they are served for detecting the stable area by the sensor 105 including a light emitting portion and a light receiving portion.

In FIG. 11B, the reference numeral 203 indicates a tension spring as urging means for holding the carriage guide shaft 12 stably, and the reference numeral 201 indicates a plate to be mounted on the right surface of the frame 75 at a predetermined inward angle, in order to hang the tension spring 203 with the carriage guide shaft 12. The tension spring 203 is hung between a latch hook formed in the plate 201 and a groove formed in the carriage guide shaft 12 and the carriage guide shaft 12 is urged toward three directions including the vertical downward direction, the printer backward direction, and the axis line direction of-the carriage guide shaft 12, to thereby obtain the following effects.

At first, although the carriage guide shaft 12 is put into the guide groove 77 extending in the vertical direction, a clearance is formed between the guide groove 77 and the shaft in the horizontal direction to some degree. Accordingly, the tension spring 203 urges the carriage guide shaft 12 toward one side inside of the guide groove 77 (in this embodiment, on the printer backward side) so to stabilize the carriage guide shaft 12 within the guide groove 77 without chatter.

At second, though the carriage guide shaft 12 is supported by the both lateral sides of the frames 75 (the details of the supporting portion is not described), it comes loose in the direction of the axis core. Accordingly, the tension spring 203 urges the carriage guide shaft 12 in the direction of the axis core, so to stabilize the above without chatter.

Figure 13A:
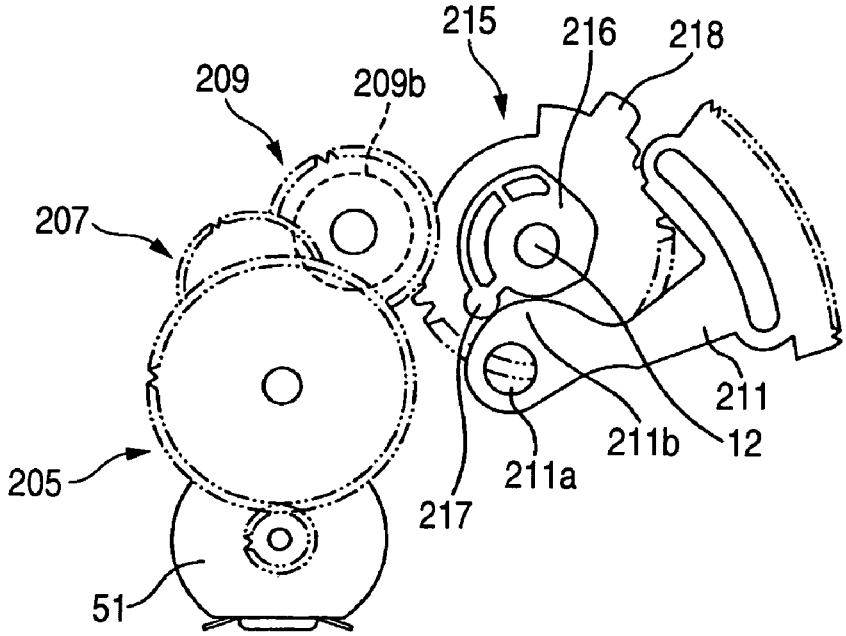
FIG. 13A is a front view showing the structure of vertically moving the carriage guide shaft.
Figure 13B:
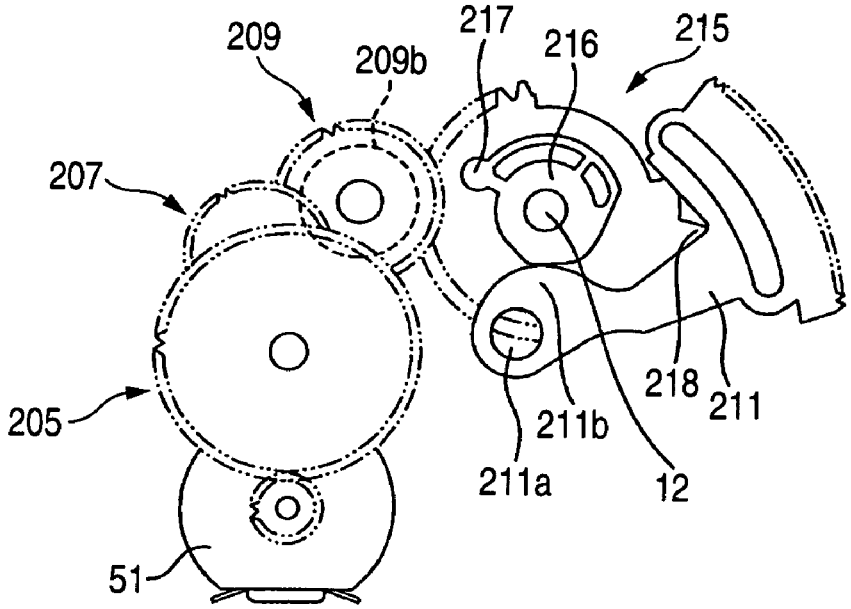
FIG. 13B is a front view showing the structure of vertically moving the carriage guide shaft.
Figure 13C:
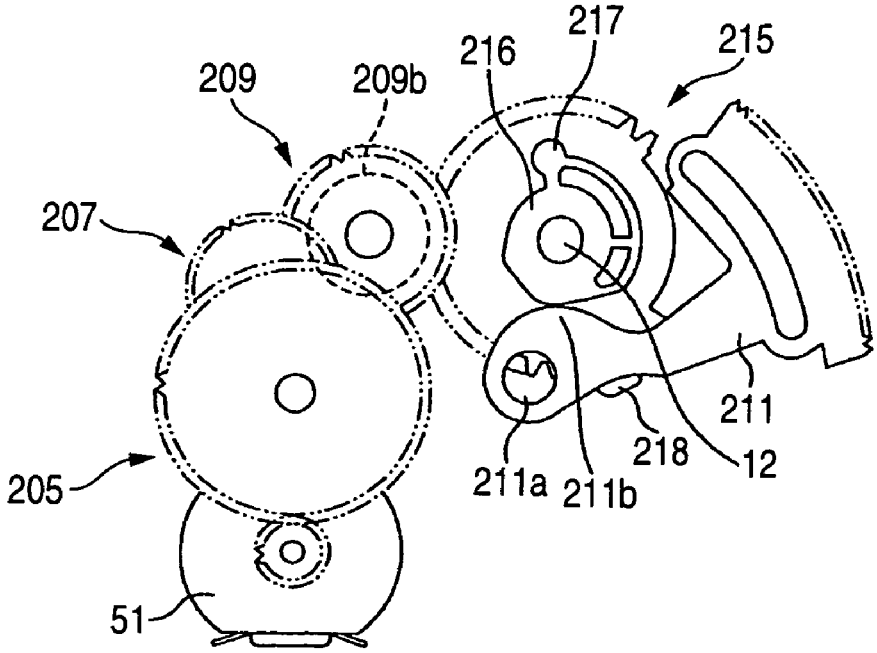
FIG. 13C is a front view showing the structure of vertically moving the carriage guide shaft.
Figure 13D:
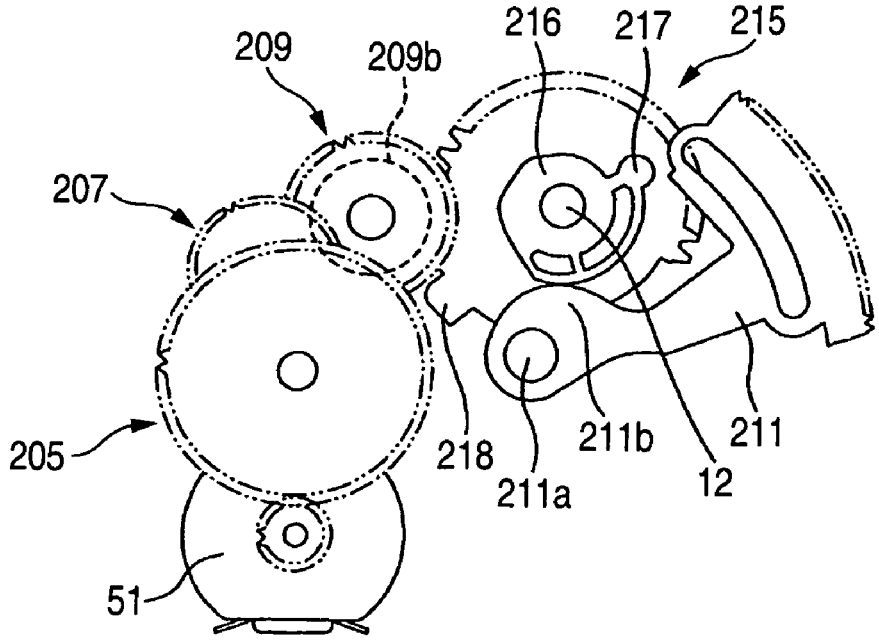
FIG. 13D is a front view showing the structure of vertically moving the carriage guide shaft.
Figure 14:
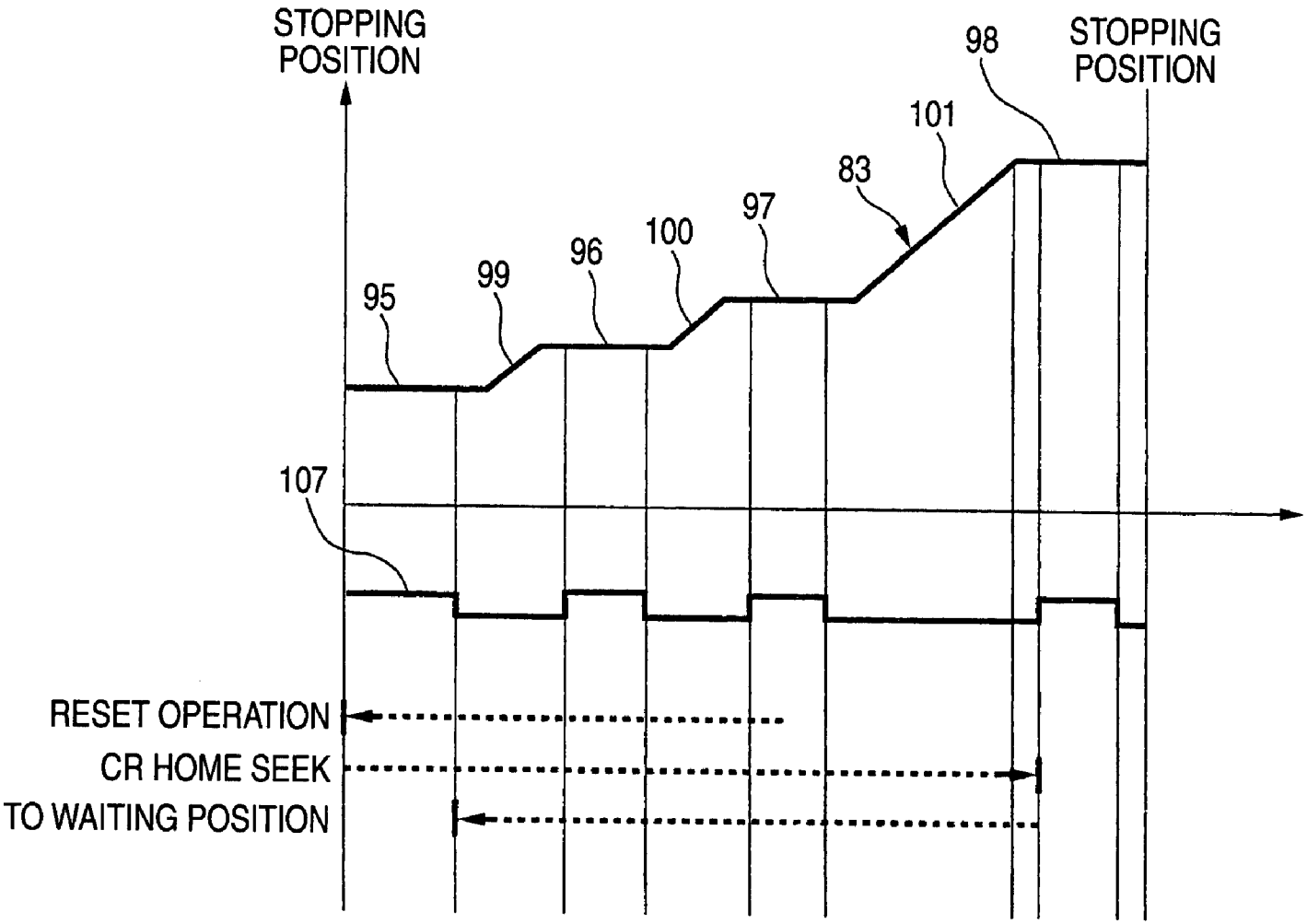
FIG. 14 is a graph showing the PG displacement and the sensor detection state.

At third, since the carriage guide shaft 12 is provided with a gap adjuster cam 216 (described later) on the left end, as illustrated in FIG. 13A, which comes into contact with the cam follower 211*b* (described later) from top down, so to define the platen gap, the tension spring 203 presses the gap adjuster cam 216 against the cam follower 211*b* so as not to upwardly displace the gap adjuster cam 216 from the cam follower 211*b*. Namely, the above cam serves a function of stabilizing the platen gap without any improper displacement.

As mentioned above, one tension coil spring 201 can stabilize the carriage guide shaft 12 in multi directions at low cost with a little space. On the left end of the carriage guide shaft 12, although a bar spring 213 shown in FIGS. 12A and 12B pushes the gap adjuster cam 216 against the cam follower 211*b* as well as urges the carriage guide shaft 12 to one side within the guide groove 77 so as not to make chatter, the tension spring 203 takes advantage of managing the load more easily than this bar spring 213.

Sequentially, the PG adjusting mechanism is provided on the left end of the carriage guide shaft 12 as illustrated in FIGS. 12A and 12B. The PG adjusting mechanism of this embodiment changes the PG by transmitting a driving force from the drive motor 51 that is the driving source of exclusive use to the guide shaft gear 215 mounted on the left end of the carriage guide shaft 12 through the first gear 205, the second gear 207, and the third gear 209 (these gears are two stepped gears), to thereby rotate the above guide shaft gear 215. These are all mounted on the left surface of the frame 75 not illustrated.

Hereinafter, the guide shaft gear 215 will be described in detail. The guide shaft gear 215 has a tooth portion to be engaged into the third gear 209, on one portion of the outer circumference and a toothless portion where a tooth portion is lost, and a projection 218 protruding in the diameter direction is formed in the boundary between the tooth portion and the toothless portion. On the other hand, the gap adjuster cam 216 is formed on the disc surface of the guide shaft gear 215 and a projection 217 protruding in the diameter direction is formed on the cam surface.

A bush 211 for parallelism adjustment is mounted on the vicinity of the guide shaft gear 215. The parallelism adjustment bush 211 is to adjust the parallelism of the carriage guide shaft 12 and mounted on the both lateral sides of the frame 75. A cam follower 211*b* is formed in the parallelism adjustment bush 211 and the platen gap is defined by the gap adjuster cam 216 pushing against the above cam follower 211*b* from top down. Namely, since the cam surface of the gap adjuster cam 216 is formed in a shape of varying the distance from the axis core of the carriage guide shaft 12 that is the rotation axis, the distance from the cam follower 211*b* of the carriage guide shaft 12 varies according to the rotation of the guide shaft gear 215, as illustrated in FIG. 13A to FIG. 13D, thereby changing the platen gap. Further, the parallelism adjustment bush 211 can swing around a hole 211*a* for a shaft not illustrated to penetrate, and by this swing, similarly, the platen gap changes. Accordingly, by sliding the both parallelism adjustment bushes 211 on the right and left, adjustment of the parallelism of the carriage guide shaft 12 is possible.

Hereinafter, the restricting mechanism for restricting the rotation range of the gap adjuster cam 216 between the stable area of the minimum platen gap and the stable area of the maximum platen gap will be described with reference to FIG. 14.

In FIG. 14, the reference numerals 95 to 98 indicate the respective stable areas and the reference numerals 99 to 101 indicate the respective transition areas, similarly to FIG. 9. The solid line 107 indicates the position where the light of the stable area detection sensor 105 is shielded, correspondingly to the solid line 83 indicating each stage of the platen gap, similarly to FIG. 9.

This embodiment is not provided with the home position detection sensor 111, differently from the above-mentioned first embodiment. Namely, in the minimum platen gap shown in FIG. 13A, since the projection 217 comes into contact with the cam follower 211*b*, the further rotation of the gap adjuster cam 216 (guide shaft gear 215) is restricted by this. As mentioned above, the gap adjuster cam 216 will be restricted to the rotation range within the above range of from the stable area of the minimum platen gap to the stable area of the maximum platen gap.

The "stopping position" shown in the both sides of FIG. 14 indicates the position of restricting the rotation of the gap adjuster cam 216 as mentioned above and at the reset operation, the drive motor 51 is rotated in the direction of bringing the projection 217 into contact with the cam follower 211*b*. Here, when the stable area detection sensor 105 does not change even if applying a drive current to the drive motor 51 for more than a predetermined hour, it is judged that the projection 217 comes into contact with the cam follower 211*b* as illustrated in FIG. 13A and namely, it is judged that the current platen gap is the minimum platen gap. Next, the platen gap is changed to the maximum while monitoring the detected signal of the stable area detection sensor 105 in order to seek the home position of the carriage (CR) 10 and again returned to the minimum platen gap, into a printing waiting state.

As mentioned above, without using the home position detection sensor 111 as shown in the first embodiment, the current position of the platen gap can be judged by using the stable area detection sensor 105, thereby saving the cost.

The invention can be applied to a recording apparatus represented by a facsimile and a printer and a liquid ejecting device, that is, a liquid ejection apparatus for attaching liquid to an ejection medium from a head for ejecting the liquid.

What is claimed is:

1. A stable area detection device for a platen gap formed between a head and an upper surface of a platen, in a platen gap adjustment device, the platen gap adjustment device comprising:

a carriage guide shaft, a guide shaft gear fixed to an end of the carriage guide shaft, a gap adjuster cam rotatable integrally with the guide shaft gear and formed in a shape to change the platen gap in a plurality of platen gap stages, a cam follower for the gap adjuster cam, and a drive motor for driving the guide shaft gear to rotate, wherein the carriage guide shaft is moved relatively to the platen so that the platen gap is adjusted by driving the drive motor to rotate the gap adjuster cam, the gap adjuster cam is configured so as to provide a plurality of stable areas corresponding to the platen gap stages where the platen gap is constant while a rotational phase of the gap adjuster cam varies in a predetermined range and a plurality transition areas where the platen gap changes between the stable areas as the rotational phase of the gap adjuster cam varies;

wherein a stable area detection sensor is provided so as to face to a rotational member which rotates synchronously with the gap adjuster cam, and a detection object which corresponds to the stable areas of the platen gap is provided on the rotational member and is detected by the sensor.

2. The stable area detection device for the platen gap according to claim 1, wherein the stable area detection sensor includes a light emitting portion and a light receiving portion and the detection object comprises a light shielding plate which passes between the light emitting portion and the light receiving portion.

3. The stable area detection device for the platen gap according to claim 1, wherein the detection object detected by the detection sensor for the stable areas is formed in correspondence with a central portion in each stable area, other than adjacent portions to the transition areas formed in both ends of said stable area.

4. The stable area detection device for the platen gap according to claim 1, wherein a home position detection sensor is provided so as to face to the rotational member, and the rotational member is provided with another detection object for the home position detection sensor at a position where the gap adjuster cam is located in a home position.

5. The stable area detection device for the platen gap according to claim 4, wherein the position where the gap adjuster cam is located in the home position is a boundary portion between the stable area of a maximum platen gap stage and the transition area adjacent to the stable area of the maximum platen gap stage.

6. The stable area detection device for the platen gap according to claim 1, wherein the gap adjuster cam includes a restricting mechanism for restricting a rotation thereof so as to be rotatable in a range from the stable area of a minimum platen gap stage to the stable area of the maximum platen gap stage.

7. A recording apparatus which performs a recording on a recording medium, the recording apparatus comprising the stable area detection device of the platen gap according to claim 1.

8. An liquid ejection apparatus which ejects a liquid on a liquid ejection medium, the liquid ejection apparatus comprising the stable area detection device of the platen gap according to claim 1.

9. A platen gap sensing device comprising:

a gap adjuster cam rotatable for changing a platen gap in a plurality of platen gap stages;

a rotational member rotatable synchronously with the gap adjuster cam;

a detection object formed on the rotational member; and a sensor facing to the rotational member so as to conduct a detection of the detection object, wherein the platen gap is determined based on a result of the detection by the sensor.

10. The platen gap sensor according to claim 9, wherein the detection object is a light shielding plate member formed on a circumferential portion of the rotational member.

11. The platen gap sensor according to claim 10, wherein a plurality of the light shielding members are formed on the circumferential portion of the rotational member.

12. The platen gap sensor according to claim 10, wherein the sensor is provided with a light emitting portion and a light receiving portion, and the detection is conducted by whether or not the light emitted from the light emitting portion is received by the light receiving portion.

* * * * *